US007490747B2

(12) United States Patent
Kitagawa

(10) Patent No.: US 7,490,747 B2
(45) Date of Patent: Feb. 17, 2009

(54) FASTENER DRIVING TOOL INCLUDING PUSH LEVER CONFIGURED TO AVOID INCLINED ORIENTATION OF THE DRIVER FASTENERS

(75) Inventor: Hiroki Kitagawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/775,925

(22) Filed: Jul. 11, 2007

(65) Prior Publication Data

US 2008/0011806 A1 Jan. 17, 2008

(30) Foreign Application Priority Data

Jul. 12, 2006 (JP) ..... P2006-191027

(51) Int. Cl.
*B25C 1/04* (2006.01)

(52) U.S. Cl. ..... 227/119; 227/8; 227/140; 227/142; 227/148

(58) Field of Classification Search ..... 227/8, 227/119, 140, 142, 148, 149
See application file for complete search history.

(56) References Cited

U.S. PATENT DOCUMENTS 3,542,273 A * 11/1970 Hedrick ..... 227/130
3,762,620 A * 10/1973 Geist ..... 227/8
4,346,831 A * 8/1982 Haytayan ..... 227/8
4,452,387 A * 6/1984 Haytayan ..... 227/8
6,095,392 A * 8/2000 Batts et al. ..... 227/8
6,161,744 A * 12/2000 Mukoyama et al. ..... 227/8
6,199,739 B1 * 3/2001 Mukoyama et al. ..... 227/8
7,255,256 B2 * 8/2007 McGee et al. ..... 227/8
7,344,057 B2 * 3/2008 Dion et al. ..... 227/8

FOREIGN PATENT DOCUMENTS

JP 10-286784 10/1998

* cited by examiner

*Primary Examiner*—Brian D Nash
(74) *Attorney, Agent, or Firm*—Antonelli, Terry, Stout & Kraus, LLP.

(57) ABSTRACT

A fastener driving tool capable of driving a fastener in a direction orthogonal to a surface of a workpiece. A fastener driving operation is performed upon manipulation of a trigger and pressing a push lever against a surface of the workpiece. The push lever is slidably movable along a nose, and is biased by a spring in a fastener driving direction. The spring is positioned offset from a center of a fastener driving tool. The push lever is slidable in a sliding axis inclined by an angle Δθ relative to the center of the fastener driving tool. The push lever is configured to provide an angle defined between the sliding axis and the surface of the workpiece in a range of more than 90 degrees, i.e., 90 degrees plus Δθ.

7 Claims, 8 Drawing Sheets

PRIOR ART

RELATED ART

FASTENER DRIVING TOOL INCLUDING PUSH LEVER CONFIGURED TO AVOID INCLINED ORIENTATION OF THE DRIVER FASTENERS

BACKGROUND OF THE INVENTION

The present invention relates to a faster driving tool for driving a fastener such as a nail and a staple into a workpiece.

A conventional fastener driving tool is shown in FIG. 7. The driving tool 101 includes a main housing 102 having a fastener injection portion 126, and a push lever 127 protruding downwardly from the injection portion 126. A driver blade (not shown) is reciprocally movably disposed in the main housing 102 for impactingly driving a fastener set in the injection portion 126. Further, a trigger is provided at the main housing 102 for initiating fastener driving operation.

The push lever 127 includes an upper section 127A formed of a metal plate, a lower section 127B and a adjuster 129 that connects the upper section 127A to the lower section 127B. The lower section 127B has a recumbent U-shape configuration and is formed by bending a metal rod. The adjuster 129 is adapted for adjusting a height of the push lever 127, i.e., a protruding length of the driver bit from the push lever in order to adjust a driving depth of the fastener.

The lower section 127B of the push lever 127 has right and left vertical wall portions 127*a*, 127*b*. Right and left guide portions 102*b*, 102*c* are provided at the main housing 102 at a position adjacent to the injection portion 126. These vertical wall portions 127*a*, 127*b* are vertically movably guided by the right and left guide portions 102*b*, 102*c*, respectively. Further, the push lever 127 is urged in a faster driving direction by a spring (not shown) disposed at one lateral side (left side or at a side of the adjuster 129 in FIG. 7) of the push lever 127.

Fastener driving operation will be started upon pulling the trigger and pressing the push lever 127 against the workpiece. That is, the fastener such as a nail will be driven by the driver blade into the workpiece. Such arrangement is disclosed in Japanese Patent Application Publication No. H10-286784.

In such conventional fastener driving tool, a fastener may be driven into the workpiece in an inclined orientation. Therefore, defects in workmanship would be found.

SUMMARY

This and other object of the present invention will be attained by a fastener driving tool including a main housing, a trigger, a driver blade, a push lever, and a biasing member. The main housing has a fastener injection portion. The trigger is supported to the main housing. The driver blade is movable in the main housing and is aligned with a driving center for striking against a fastener set in the fastener injection portion. The push lever is supported to the main housing and is slidably movable on a sliding axis. The push lever has a contact surface in contact with a surface of the workpiece. The biasing member biases the push lever in a faster driving direction and is positioned offset from the driving center. Fastener driving operation is performable upon operation of the trigger and pressing the push lever against the surface of the workpiece. The push lever is configured to provide an angle defined between the sliding axis and the contact surface in a range of more than 90 degrees.

DETAILED DESCRIPTION

A fastener driving tool according to a first embodiment of the present invention will be described with reference to FIGS. 1 through 6. A pneumatically operated stapler 1 will be described as the fastener driving tool.

Figure 2:
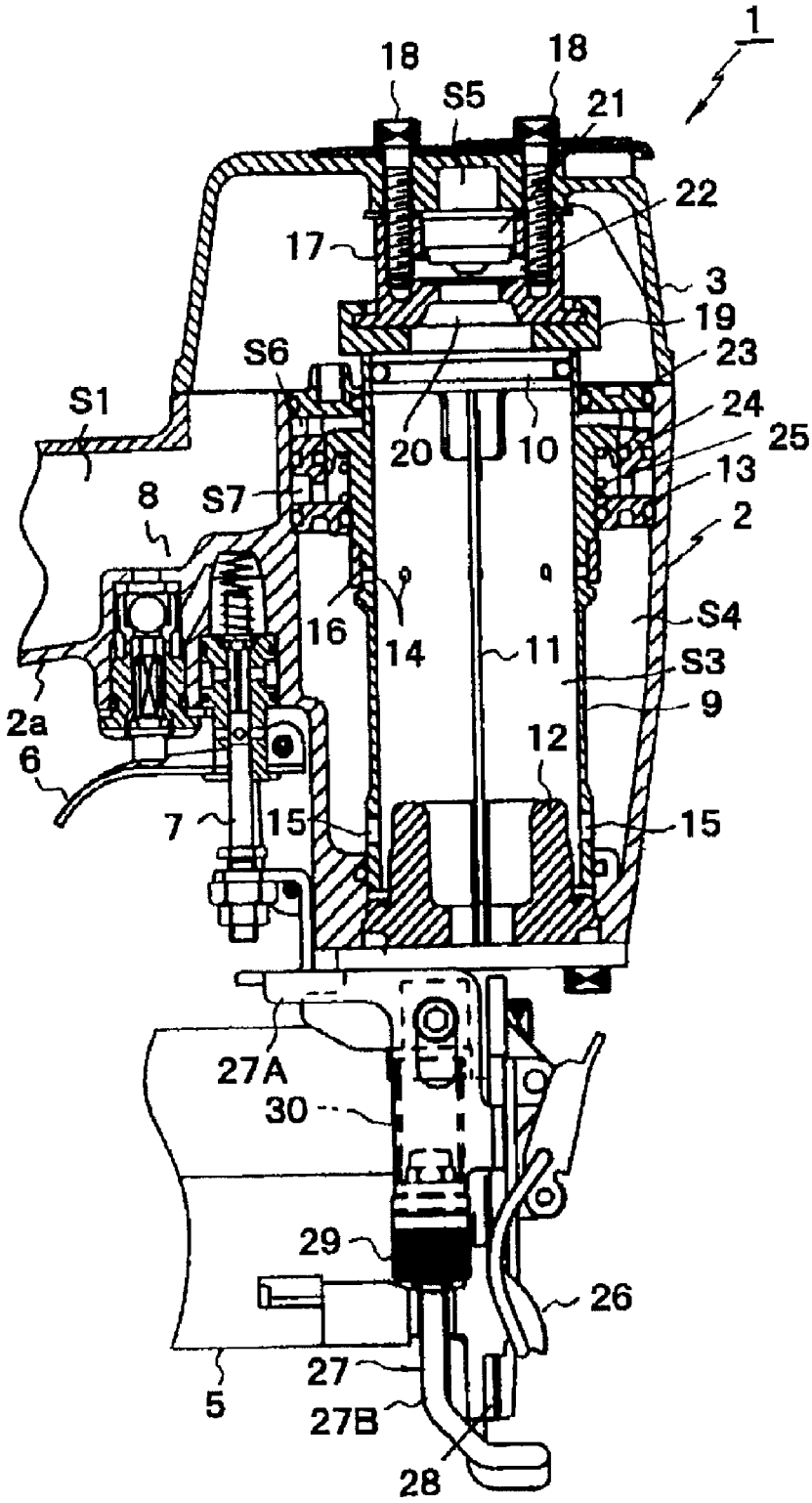
FIG. 2 is a cross-sectional view of the fastener driving tool according to the embodiment and showing a state where a cylinder is seated on a head cap and a piston is at its top dead center position.

The stapler 1 has a main housing 2 whose upper opening is fluid-tightly covered with an exhaust cover 3 with a plurality of bolts 4 (four bolts). As shown in FIG. 2, an accumulation chamber S1 is defined in an interior of the main housing 1 for accumulating a compressed air. The main housing 2 includes a handle portion 2*a*, whose free end portion is provided with an air plug (not shown) to which an air hose (not shown) extending from a compressor (not shown) is connected.

A magazine 5 is attached to the main housing 2 for accommodating a plurality of staples (generally u-shaped fasteners). Further, a trigger valve 8 is provided at the main housing 2. The trigger valve 8 includes a plunger 7 vertically movable by the trigger 6. Incidentally, the expressions "front", "rear", "above" and "below" are used throughout the description to define the various parts when the exhaust cover is an uppermost component of the stapler 1.

As shown in FIG. 2, in the main housing 2, a cylinder 9 vertically extends and is movable in its axial direction. A piston 10 is reciprocally slidably movably disposed within the cylinder 9. The piston 10 divides an interior of the cylinder 9 into an upper chamber S2 (FIG. 3) and a lower chamber S3 (FIG. 2). A driver blade 11 extends in the lower chamber S3 and has one end connected to the piston 10. A piston bumper 12 made from an elastic material such as a rubber is disposed at a bottom end portion within the cylinder 9. The piston bumper 12 allows the piston 10 to bump thereagainst to absorb kinetic energy of the piston 10.

Further, a cylindrical return chamber S4 is defined by a lower outer peripheral surface of the cylinder 9 and an inner surface of the main housing 2. A plurality of upper air vent through-holes 14 and lower air vent through-holes 15 are formed in the part of cylinder 9, the part defining the return chamber S4. These through-holes 14 and 15 are arrayed in the circumferential direction of the cylinder 9. Check-valves 16 are positioned to overlap with the upper air vent through-holes 14 for allowing compressed air to flow only from the upper chamber S2 to the return chamber S4.

A valve seat member 17 is supported to the exhaust cover 3 by a plurality of bolts 18, and the valve seat member 17 has a lower outer peripheral end portion covered with a head cap 19. An air passage 20 is defined at a radial center of the valve seat member 17 and the head cap 19. An exhaust valve 21 is vertically movably disposed in the valve seat member 17 to selectively open the air passage 20. An air passage 22 is formed in the valve seat member 17, and an exhaust hole (not shown) is formed in the exhaust cover 3. The air passage 20 is in selective fluid communication with an atmosphere through the air passage 22 and the exhaust hole. An exhaust valve chamber S5 is defined at an upper side of the exhaust valve 21. The exhaust valve chamber S5 is in selective fluid communication with the trigger valve 8 through an air passage (not shown).

Annular partition walls 23, 24 and 13 are immovably disposed between an upper outer peripheral surface of the cylinder 9 and the inner surface of the main housing 2. The partition walls 23 and 24 define a first chamber S6, and the partition walls 24 and 13 define a second chamber S7. The cylinder 9 has an upper flange portion, and a compression spring 25 is interposed between the flange portion and the partition wall 13 in the second chamber S7 for biasing the cylinder 9 upward. The first and second chambers S6, S7 are selectively applied with compressed air pressure or atmospheric pressure in accordance with the operation of the trigger 6.

A nose 26 providing a fastener injection portion is disposed at a lower end of the main housing 2. The nose 26 is formed with an injection opening 28 at which each staple fed in the magazine 5 is set. Further, a push lever 27 is disposed slidably movable along the nose 36.

Figure 3:
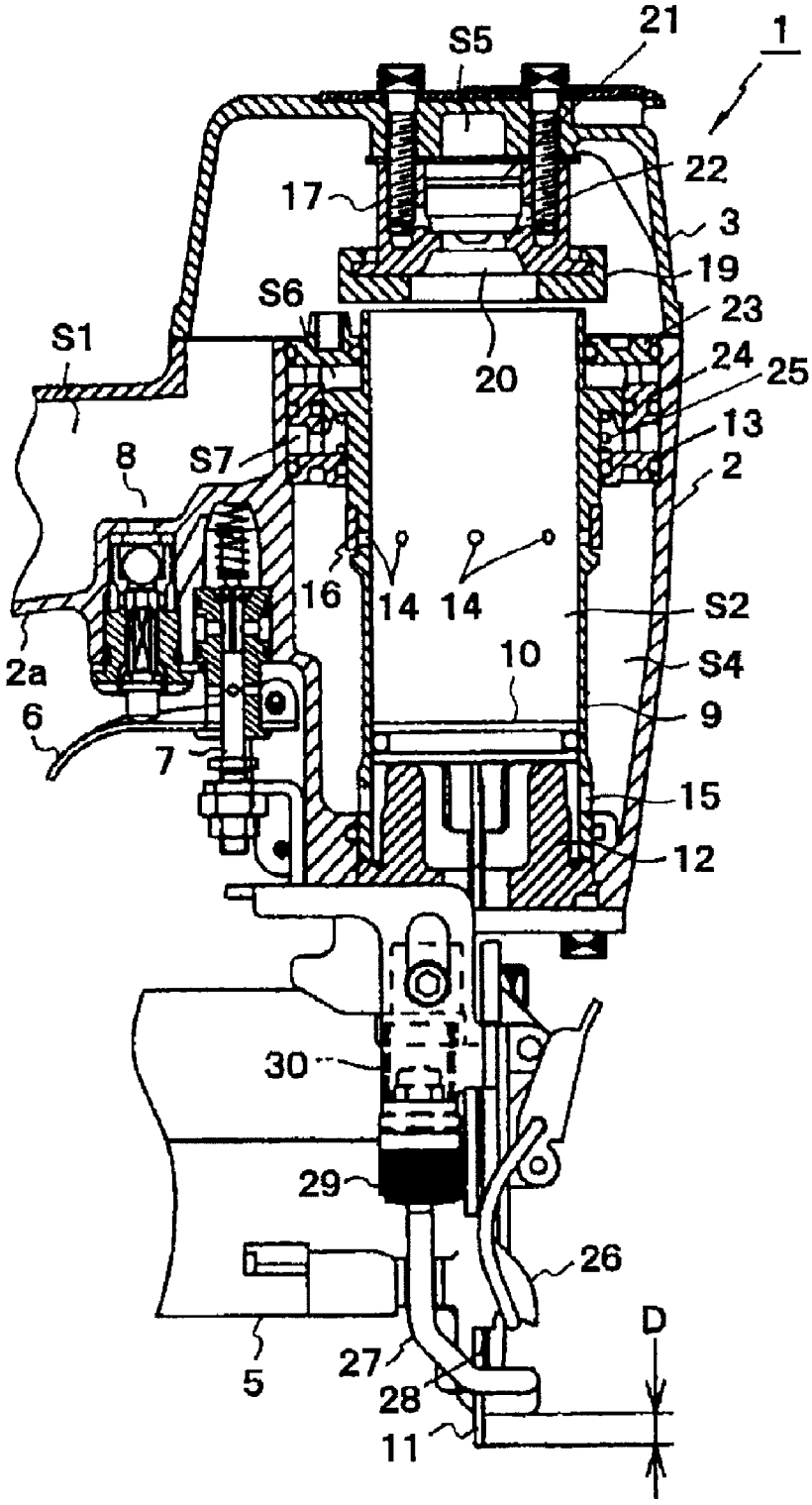
FIG. 3 is a cross-sectional view of the fastener driving tool according to the embodiment and showing a state where the cylinder is separated from the head cap and the piston is at its bottom dead center position, and a driver bit protrudes from a push lever by a length D.
Figure 5:
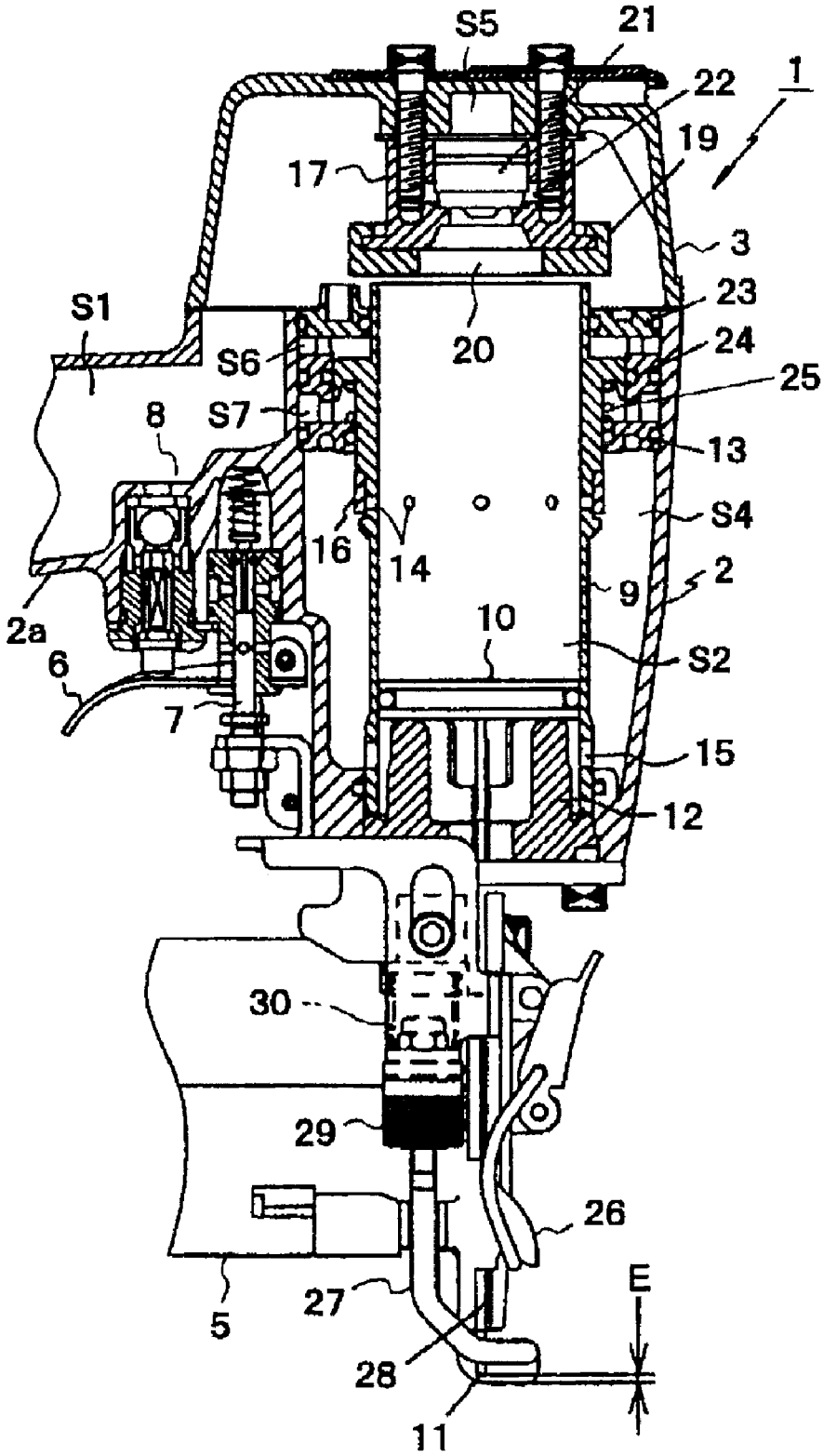
FIG. 5 is a cross-sectional view of the fastener driving tool according to the embodiment and showing a state where the driver bit protrudes from the push lever by a length E.

The push lever 27 includes an upper segment 27A made from a metal plate, and a lower segment 27B provided by bending a metal rod into recumbent U-shape configuration. The upper segment 27A has an upper end portion connected to a lower end of a plunger 7 of the trigger valve 8. The lower segment 27B is adapted to be in surface contact with the workpiece W. An adjuster 29 is disposed at a junction between the upper and lower segments 27A and 27B. The adjuster 29 is adapted for adjusting a height of the push lever 27, i.e., a protruding length of the driver blade 11 from the push lever 27 in order to adjust a driving depth of the staple. More specifically, FIG. 3 shows a maximum protruding length D of the driver blade 11 from the lower segment 27B, and FIG. 5 shows a minimum protruding length E.

Figure 6:
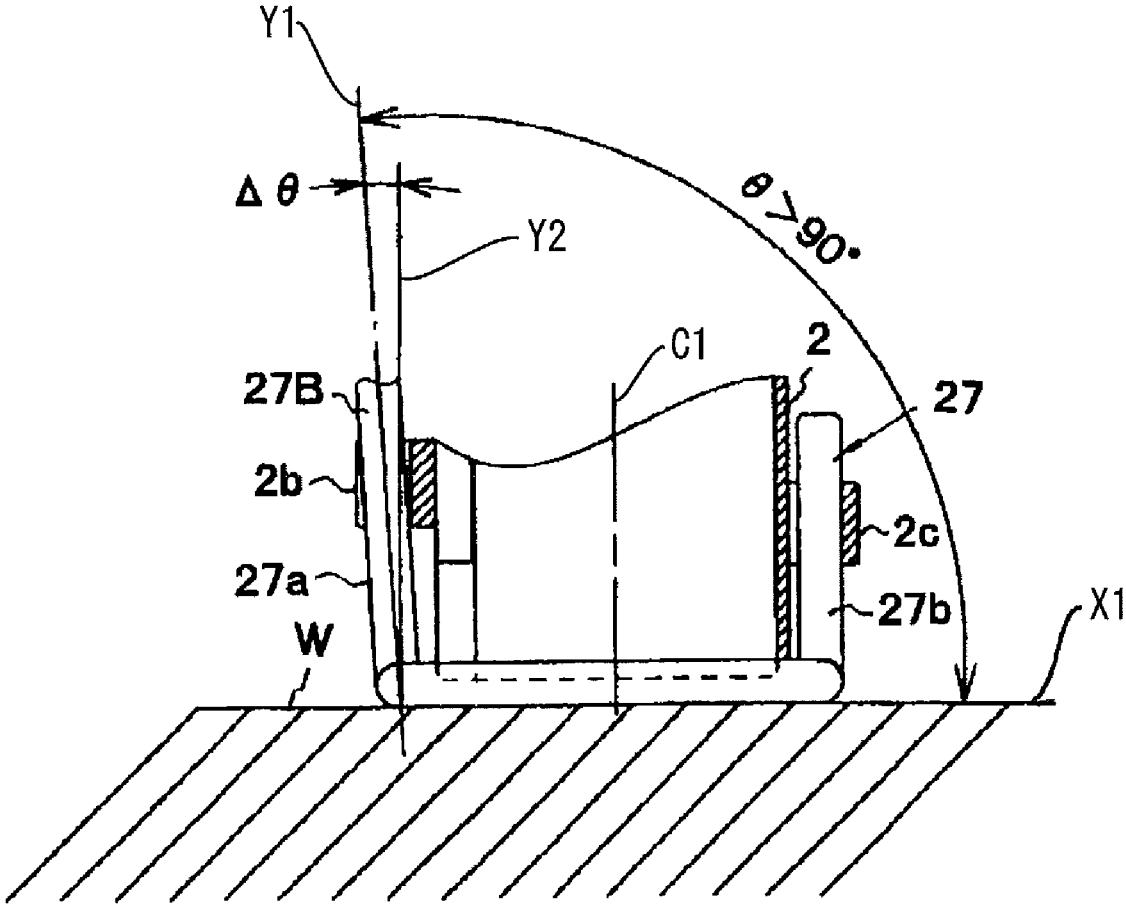
FIG. 6 is an enlarged front view of an essential portion of the embodiment and showing a state where the push lever is pressed against a workpiece.
Figure 7:
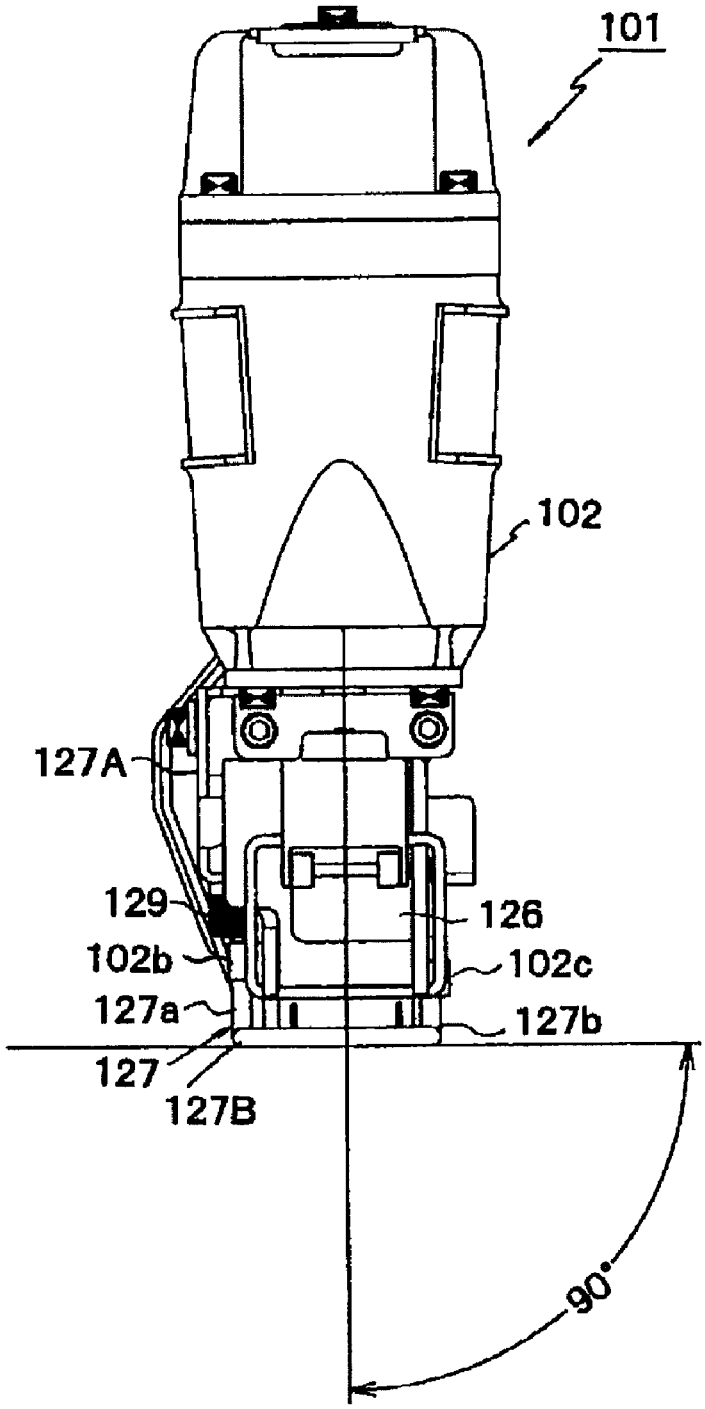
FIG. 7 is a front view of a conventional fastener driving tool.

The lower segment 27B includes left and right walls 27*a*, 27*b* each being vertically slidably movably guided by left and right guide portions 2*b* and 2*c* of the nose 26. A spring 30 is interposed between the lower segment 27B and the nose 26 for biasing the push lever 27 in a fastener driving direction. The spring 30 is positioned close to the left wall 27*a*, i.e., a position between the left wall 27*a* and the nose 26. During non-operational phase of the driving tool 1, the lower end face of the lower segment 27B is positioned below the lower end face of the nose 26. As shown in FIG. 6, a minute gap is formed between the left wall 27*a* and the guide portion 2*b*, and another minute gap is formed between the right wall 27*b* and the guide portion 2*c* in order to enhance slidability of the push lever 27.

Figure 1:
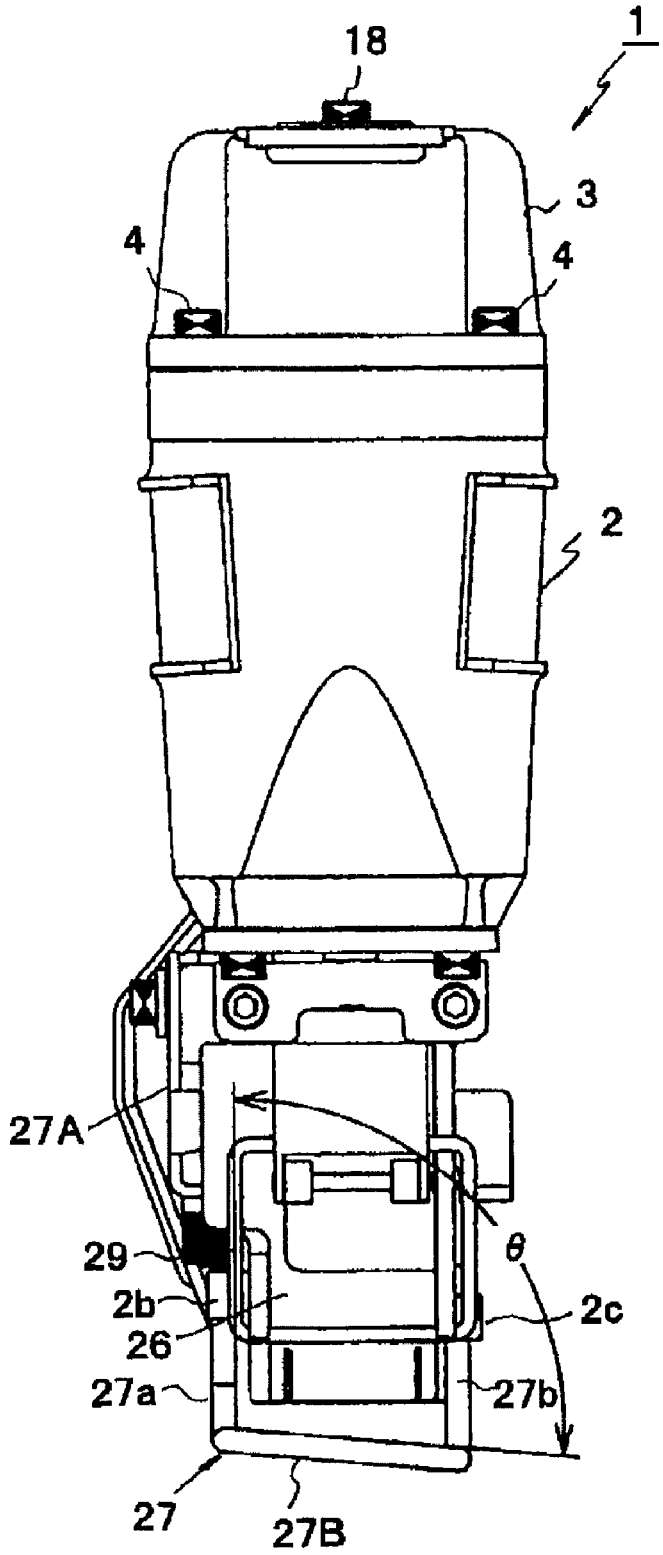
FIG. 1 is a front view of a fastener driving tool according to an embodiment of the present invention.

As shown in FIG. 6, the push lever 27 is slidably movable in a sliding axis Y1, and the lower segment 27B is configured such that an angle θ defined between the sliding axis Y1 and a contacting surface X1 between the workpiece W and the lower segment 27B is greater than 90 degrees (θ>90°) as viewed from a front side (FIG. 1). More specifically, the spring 30 is positioned in the vicinity of one of the walls of the lower segment 27B, that is left side wall 27*a*, and the left side wall 27*a* is inclined by an angle Δθ with respect to a vertical plane Y2. Preferably, the angle Δθ is not more than 5° and therefore, the angle θ is greater than 90° and preferably not more than 95° (90°<θ≦95°)

Operation of the stapler 1 will be described. The user connects the air hose (not shown) to the air plug (not shown), whereupon a compressed air is delivered from the compressed air source such as a compressor and is filled in the accumulation chamber S1. A part of the compressed air will be supplied to the second chamber S7, whereas the first chamber S6 and the exhaust valve chamber S5 are in communication with the atmosphere. Therefore, as shown in FIG. 2, the upper end of the cylinder 9 is seated on the head cap 19 by the compressed air pressure applied to the second chamber S7 and the biasing force of the spring 25. As a result, fluid communication between the accumulation chamber S1 and the upper chamber S2 in the cylinder 9 is shut off, preventing the compressed air from being flowed from the accumulation chamber S1 into the upper chamber S2. Consequently, the piston 10 and the driver blade 11 are maintained in their top dead center positions. Thus, staple driving operation cannot be performed. In this instance, the exhaust valve 21 is at open phase to allow the air passage 20 to communicate with the atmosphere.

Then, if the lower section 27B of the push lever 27 is pressed against the workpiece W as shown in FIG. 6, and if the trigger 6 is pulled, the plunger 7 of the trigger valve 8 is moved upward to render the trigger valve 8 ON. Therefore, compressed air in the accumulation chamber S1 will be supplied into the first chamber S6 and the exhaust valve chamber S5, whereas the second chamber S7 will be communicated with the atmosphere. Then, the cylinder 9 will be moved downward by the compressed air pressure in the first chamber S6 against the biasing force of the spring 25 as shown in FIG. 3. Thus, the upper end of the cylinder 9 will be separated from the head cap 19. Consequently, the accumulation chamber S1 will be communicated with the upper chamber S2, so that the compressed air in the accumulation chamber S1 will be introduced into the upper chamber S2 through a gap between the upper end of the cylinder 9 and the head cap 19. Simultaneously, the exhaust valve 21 will be moved downward within the valve seat member 17 by the compressed air pressure supplied into the exhaust valve chamber S5 to close the air passage 20.

By the closure of the air passage 20 by the exhaust valve 21 and by the introduction of compressed air into the upper chamber S2, the piston 10 and the driver blade 11 are promptly moved downward toward their bottom dead center within the cylinder 9. Thus, a staple supplied from the magazine 5 and set at the injection opening 28 of the nose 26 will be subjected to driving by the driver blade 11. The staple is guided by the injection opening 28 and is driven into the workpiece W. If the piston 10 is moved past the upper air vent through-holes 14 during downward moving stroke, the compressed air in the upper chamber S2 will be introduced into the return chamber S4 through the upper air vent through-holes 14 and the check valves 16, so that compressed air will be accumulated in the return chamber S4. Further, if the piston 10 reaches the bottom dead center as shown in FIG. 3 in the downward movement thereof, the piston 10 bumps against the piston bumper 12 and, the bumper 12 will be elastically deformed. Thus, surplus energy of the piston 10 will be absorbed by the elastic deformation.

In the depicted embodiment, as described above, the angle θ defined between the sliding axis Y1 and the contacting surface X1 is greater than 90 degrees (θ>90°) as viewed from the front side, and preferably, the angle θ is in a range of 90°<θ≦95°. Advantage of this angle will be described with reference to a comparative example shown in FIG. 8.

In the comparative example, the angle defined between the sliding axis Y1 and the contacting surface X1 is 90°. Further, similar to the above-described embodiment, the spring 30 for biasing the push lever 127 toward the staple driving direction is not aligned with a center C1 of the driving tool, but is offset toward the left side wall 127*a* of the lower segment 127B (toward the adjuster 129). With this arrangement, the present inventor has found the following result.

Figure 8:
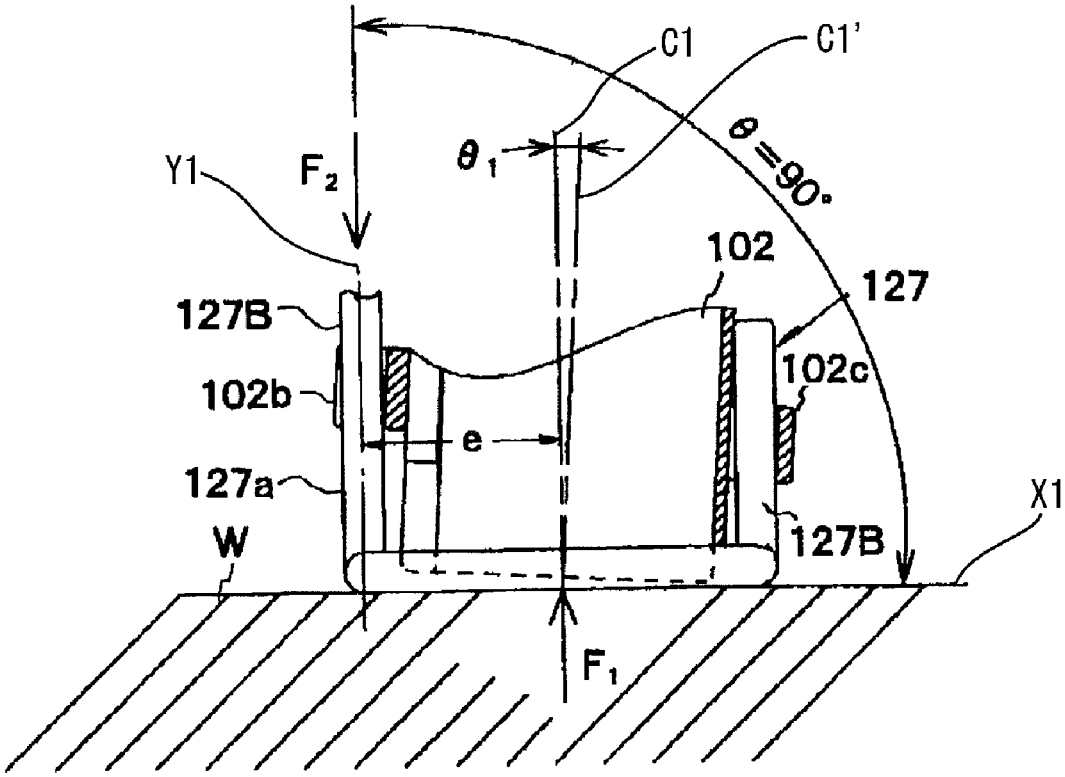
FIG. 8 is an enlarged front view of an essential portion of a comparative example.

That is, if the push lever 127 is pressed against the workpiece W and the trigger is pulled for starting driving operation, in FIG. 8, upward reaction force F1 is exerted on the push lever 127 from the workpiece W at a driving center C1 of the driving tool, whereas downward force F2 is exerted on the push lever 127 by the spring 30. Therefore, a moment of a couple will be exerted on the push lever 127, since the force F2 is offset from the driving center C1 by a length "e". As described above, minute gaps are provided between the push lever 127 and the guide portions 102*b*, 102*c* in order to smoothen the sliding movement of the push lever 127. Therefore, if the moment of a couple is generated, the driving center C1 will be included to C1' by an angle θ1. In other words, the line C1' is not orthogonal to the surface X1. Consequently, a fastener such as a staple will be driven in an inclined orientation in the direction C1, degrading workmanship.

Taking this phenomenon into consideration, in the illustrated embodiment, the angle Δθ is set equal to the angle θ1. That is, the angle θ1 due to the moment of a couple is provisionally envisioned, so that the push lever 27 is inclined by an angle Δθ in order to orient the center axis C1 of the driving tool in a direction orthogonal to the contacting surface X1 during staple driving operation. Thus, the staple can be driven into the workpiece in a direction orthogonal to the surface of the workpiece.

Figure 4:
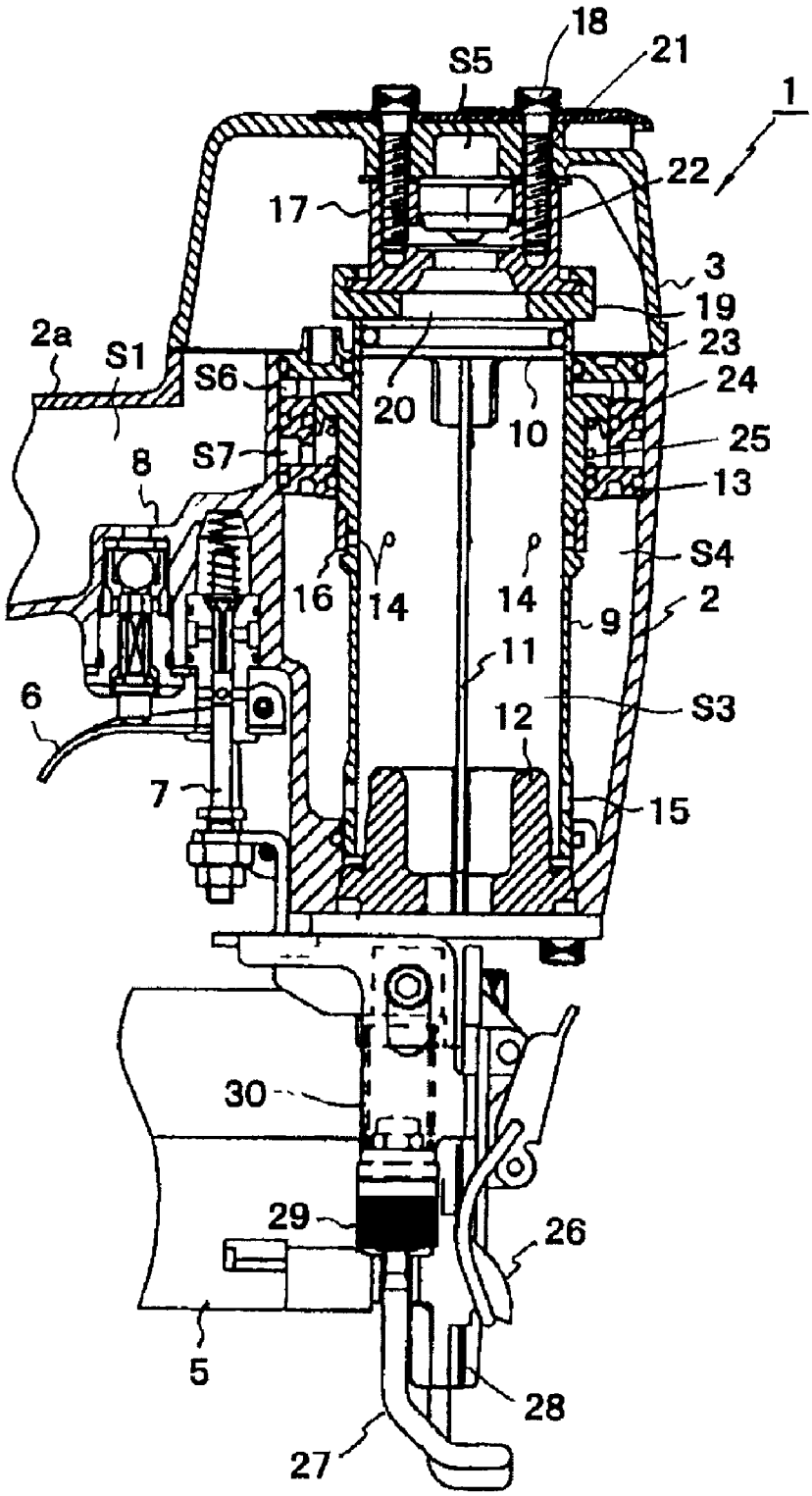
FIG. 4 is a cross-sectional view of the fastener driving tool according to the embodiment and showing a state where the cylinder is again seated on the head cap and the piston is returned to its top dead center position.

Next, if the trigger 6 is released, or the push lever 27 is moved away from the workpiece W, the plunger 7 restores its original position to render the trigger vale 8 OFF. As a result, compressed air will be supplied into the second chamber S7 whereas the first chamber S6 and the exhaust valve chamber S5 are brought into communication with the atmosphere. Consequently, the cylinder 9 will be moved upward as shown in FIG. 4 by the compressed air pressure applied to the second chamber S7 and biasing force of the spring 25. Thus, the upper end of the cylinder 9 will be seated on the head cap 19 to shut-off fluid communication between the upper chamber S2 and the accumulation chamber S1. Further, the exhaust valve 21 will be moved upward within the valve seat member 17 to open the air passage 20, so that the air passage 20 will be brought into communication with the atmosphere.

Then, the compressed air accumulated in the return chamber S4 will be introduced into the lower chamber S3 through the lower air vent through-hole 15, so that the compressed air pressure will be applied to a lower surface of the piston 10 to rapidly move the piston 10 and the driver blade 11 toward their top dead center position. In accordance with this movement, air in the upper chamber S2 will be discharged to atmosphere through the air passages 20, 22 and the exhaust hole (not shown) formed in the exhaust cover 3. Thus, the piston 10 and the driver blade 11 will be returned to their original positions.

The above-described operation will be repeatedly performed. Thus, the staples accommodated in the magazine 5 will be successively driven into the workpiece W.

While the invention has been described in detail with reference to specific embodiment thereof, it would be apparent to those skilled in the art that various changes and modifications may be made therein without departing from the scope of the invention. That is, the present invention is available to an electrically driven fastener driving tool and combustion type fastener driving tool as well as pneumatically operated fastener driving tool. The driving system is not requisite matter. Further, the present invention is also available for other fastener driving tools such as a nail gun.

What is claimed is:

1. A fastener driving tool comprising:

a main housing having a fastener injection portion;

a trigger supported by the main housing;

a driver blade movable in the main housing and aligned with a driving center for striking against a fastener set in the fastener injection portion; and a push lever supported by the main housing and slidably movable on a sliding axis, the push lever having a first portion to extend along a surface of the workpiece when placed in contact with the surface of the workpiece, and further having a second portion fixed to the first portion and extending upwardly from the surface of the workpiece when the first portion is placed in contact with the surface of the workpiece; and a biasing member that bias the push lever in a fastener driving direction and positioned offset from the driving center, fastener driving operation being performable upon operation of the trigger and pressing the push lever against the surface of the workpiece, wherein the push lever is configured to provide an angle defined between the first portion and the second portion of the push lever in a range of more than 90 degrees, when the fastener driving tool is viewed from the front.

2. The fastener driving tool as claimed in claim 1, wherein the angle is not more than 95 degrees.

3. The fastener driving tool as claimed in claim 1, wherein the push lever comprises an upper segment, and a lower segment connected to the upper segment and including the first portion defining the contact surface and the second portion including a left wall and a right wall, the biasing member being located close to one of the left wall and the right wall; and wherein the one of the left wall and the right wall close to the biasing member is inclined with respect to a vertical plane to provide the angle.

4. The fastener driving tool as claimed in claim 3, further comprising a trigger valve including a plunger, the upper segment of the push lever having an upper end connected to the plunger.

5. The fastener driving tool as claimed in claim 3, further comprising an adjuster provided at a junction of the upper segment of the push lever and the lower segment of the push lever for adjusting a protruding length of the driver blade from the contact surface.

6. The fastener driving tool as claimed in claim 5, wherein the biasing member is located close to the adjuster.

7. A fastener driving tool comprising:

a main housing having a fastener injection portion;

a trigger supported by the main housing;

a driver blade movable in the main housing and aligned with a driving center for striking against a fastener set in the fastener injection portion; and a push lever supported by the main housing and slidably movable on a sliding axis, the push lever having a first portion to extend along a surface of the workpiece when placed in contact with the surface of the workpiece, and further having a second portion fixed to the first portion and extending upwardly from the surface of the workpiece when the first portion is placed in contact with the surface of the workpiece; and a biasing member that bias the push lever in a fastener driving direction and positioned offset from the driving center, fastener driving operation being performable upon operation of the trigger and pressing the push lever against the surface of the workpiece, means for offsetting a moment of couple exerted on the push lever by an upper reaction force F1 exerted on the push lever from the workpiece at a driving center of the driving tool and a downward force F2 exerted on the push lever by a driving spring of the fastener driving tool, said means comprising the push lever being configured to provide an angle defined between the first portion and the second portion of the push lever in a range of more than 90°, when the fastener driving tool is viewed from the front.

* * * * *